US005195567A

United States Patent [19]

Tyree, Jr.

[11] Patent Number: 5,195,567

[45] Date of Patent: Mar. 23, 1993

[54] FILLER FOR SMALL TANKS OR THE LIKE

[76] Inventor: Lewis Tyree, Jr., Mulberry Hill, Liberty Hall Rd., Lexington, Va. 24450

[21] Appl. No.: 813,125

[22] Filed: Dec. 23, 1991

Related U.S. Application Data

[63] Continuation-in-part of Ser. No. 514,295, Apr. 25, 1990, Pat. No. 5,074,343.

[51] Int. Cl.[5] ..... B67C 11/00

[52] U.S. Cl. ..... 141/331; 141/95; 141/297; 141/300; 141/337; 141/340; 73/294

[58] Field of Search ..... 141/331-333, 141/337-345, 297-300, 95, 98; 73/294

[56] References Cited

U.S. PATENT DOCUMENTS

| | | | |
|---|---|---|---|
| 279,739 | 6/1883 | Gifford | 141/299 |
| 426,165 | 4/1890 | Brittin | 141/339 |
| 2,868,246 | 1/1959 | Nelson | 141/344 |
| 3,973,602 | 8/1976 | Kruse | 141/95 |
| 4,202,386 | 5/1980 | Orr | 141/300 |
| 4,559,984 | 12/1985 | Wycech | 141/340 |
| 4,850,403 | 7/1989 | Wiese | 141/95 |
| 4,901,776 | 2/1990 | Attinello | 141/95 |

FOREIGN PATENT DOCUMENTS

| | | | |
|---|---|---|---|
| 0253142 | 6/1911 | Fed. Rep. of Germany | 141/299 |
| 0335934 | 11/1919 | Fed. Rep. of Germany | 141/345 |
| 0358853 | 7/1921 | Fed. Rep. of Germany | 141/345 |
| 1087062 | 2/1955 | France | 141/331 |
| 1179560 | 5/1959 | France | 141/297 |

*Primary Examiner*—Henry J. Recla
*Assistant Examiner*—Casey Jacyna
*Attorney, Agent, or Firm*—Fitch, Even, Tabin & Flannery

[57] ABSTRACT

Filling units for supplying small tanks or the like with gasoline, kerosene, or other flowable materials which attach to an inlet to such a tank. When the filling unit is in a fill position, a displacer section occupies a substantial volume within the tank. It allows the person filling the tank to supply the liquid until the tank will accept no more and the liquid reaches a predetermined level in a funnel portion of the filler. Thereafter, manipulation of the displacer section vertically within the tank, as for example by sliding a section of the overall unit upward, accommodates all the liquid remaining in the funnel up to such predetermined level within the tank by occupying the volume previously occupied by the displacer section and thereby completing the filling of the tank to a full condition without any spillage. The overall unit may be such that it is intended to be removed from the tank after each filling operation, or it may be designed to fit permanently within a wide-mouth tank inlet and to be movable downward to a storage orientation which allows the unit to remain mounted in the tank inlet and covered by the protective cap that normally screws onto the inlet opening to close it.

14 Claims, 6 Drawing Sheets

FILLER FOR SMALL TANKS OR THE LIKE

This application is a continuation-in-part of application Ser. No. 514,295, filed Apr. 25, 1990, now U.S. Pat. No. 5,074,343.

This patent is available for licensing or purchase. The invention relates generally to funnel-like fillers and more particularly to such units designed to mount on small tanks.

BACKGROUND OF THE INVENTION

The filling of small tanks with liquids has long been a source of inventive ideas, particularly as small gasoline motors and kerosene heaters have proliferated. Inventions of many types have resulted.

Funnels have been designed with almost every type of signal to indicate when the tank is full. Some devices require the small vessel containing the source liquid to be equipped with special spouts. Some spouts have a mechanical trip valve at the end which rests on the mouth of the tank to be filled, with the operator moving the source liquid tank to open or close the trip valve, making such decision by observing the liquid level through the tank opening. A common problem with the valved spouts is visually seeing the liquid level inside the tank so as to know when to stop pouring. Frequently, the first indication of being "filled" is also an overflow.

Some have spouts which contain two passages, one for liquid being poured, the other for the return air, and the dual passage spout is inserted into the to-be-filled tank's opening. When the liquid level therein rises with filling, the return air vent is covered so that flow characteristics change, and the operator then lowers the source tank to where flow isn't possible.

In a variation of the return air control, a dual passage, transparent connection line is connected to the openings of both the tank to be filled and the source tank. The operator observes the return flow through the transparent connection line and controls the flow by raising or lowering the source tank.

Each of these inventions has had some shortcoming, as none has become a universally accepted solution. A general problem with prior funnel devices has been either their complexity (valves, air passages, etc.) or the funnel's resting in the tank opening which obscures the view of the liquid level in the tank.

It can be observed that, when pouring at normal rates into a funnel, a certain liquid level tends to accumulate in the lower portion of a conical funnel, just above where the liquid enters the throat. This occurs whether the funnel is conical with a round (straight or tapered) throat or is of square, rectangular, ellipsoidal or compound cross section. When the tank below the funnel becomes full, the level in the funnel cone rises higher, indicating to the operator to lower the source tank and cease filling. Almost invariably this has already resulted in overfilling and consequent spillage.

In general, there are two common problems: seeing the liquid level as the tank becomes full and what to do with the "lag time" liquid that invariably occurs between seeing that "full" has occurred and lowering or adjusting the source tank so as to actually cause flow to stop. The "lag time" liquid can represent a substantial amount and is particularly dangerous if it is spilled due to overfilling. In addition, it is desirable to not solidly connect the to-be-filled tank to the source tank, both because of the physical constraints and because of potential leak sources created during filling.

Accordingly, it is desirable to have a funnel to introduce the filling liquid into the mouth of the to-be-filled tank, allowing free-flow from the source tank (or its nozzle). It is also desirable to provide an easily visible level indication when a "full" condition has been reached. It is further desirable to provide a method of accepting a "lag time" apparent overfill without a resultant spill no matter what specific type of spout is used. It is still further desirable that such overfill method control be independent of the shape of the tank to be filled (i.e. if an air gap is created in the tank by the location of the return air vent in a sealably engaged funnel device, the air gap can easily vary in volume depending on the shape and/or orientation of the tank).

SUMMARY OF THE INVENTION

This invention provides a filling unit which is sealed to the tank being filled and includes a displacer integral with and depending from a funnel section, that, during the filling procedure, resides in the container so as to allow an apparent "overfill" of preferably at least a minimum predetermined volume to be subsequently accommodated. The displacer is then vertically moved, as by manipulation or translation. For example, it may be removed, and when removed, allows all the "overfill" liquid to run into the container.

A number of calculated volume funnel-displacer combinations are revealed herein which provide solutions to the foregoing long-experienced problems. The typical simple funnel is an open-topped frustum of a cone with its small end connected to a throat. A number of shape variations can occur, but in theory they perform similarly to the simple funnel. The volume of a frustum of a cone is represented by the formula: $V=0.26h(D^2+Dd+d^2)$ where V is volume, h is height of the frustum, D is diameter of the large end of the frustum, and d is the diameter of the small end of the cone frustum (where the funnel's throat connects). Of course, funnels are required in a variety of sizes, and they are typically proportioned to the tank opening with which they are designed to be used. Likewise, the throat is generally proportioned to the funnel size. In pouring through a funnel, normal liquid buildup in the frustum tends to occur whether the throat is small or whether the throat is large and/or tapered. The key element in funnel acceptance rate has been found to be the smallest portion of the funnel throat (cross section area). The necessary "lag time" volume required in the funnel frustum for adequate eye-hand coordination has been found to be mathematically related to the smallest portion of the funnel throat. Thus, it has been found that a level in the funnel which represents a volume necessary to safely allow filling can be related to the throat area, and it can be effectively compensated by incorporating a displacer within the tank being filled. The following formula has been found to represent the minimum volume desired in the funnel, which should be effectively compensated for by the "displacer volume": $V=0.26\times 4d(d^2+dD+D^2)$, where V is volume, d is the diameter of a circle of equivalent area to minimum throat area, and D is d times 5. This formula factors to V equals about 32 $d^3$.

Thus, to function in this manner, it has been found that this displacer volume is preferably established in the tank at the time of filling, with the funnel in sealing engagement to the tank, and that the utilization of the displacer volume should occur either before or simultaneously with breaking the sealing engagement. Preferably, a separate air vent is also provided.

One anti-spill filling unit may be designed to attach in sealing engagement to a fuel tank or the like in the same manner as the fuel tank closure cap, which is first removed to provide entry to the tank. Once such a unit is attached, a funnel portion is moved downward, so that a displacement end section enters the fuel tank as far as permitted. When fuel is thereafter poured into the funnel, it freely flows into the fuel tank, and air or vapor is preferably allowed to escape through a vent arrangement which is integral to the unit and which is located above the predetermined level within the funnel to which it is desired filling should extend. Once the tank has become nearly full, the air vent floods, causing fuel to build up in the funnel where it is easily observable and allowing further pouring to readily be stopped. The funnel portion is then moved upward by translation and/or twisting, preferably without breaking the seal to the tank, to allow the fuel within the funnel to drain downward into the empty volume created when the displacement section of the funnel is moved upward out of the main body portion of the fuel tank. This particular anti-spill unit is then removed from the fuel tank inlet, and the fuel tank closure is replaced.

In respect of another aspect of the invention, a different anti-spill filling unit is provided that is particularly designed for use with as a permanent installation in a tank having a wide mouth inlet, for example, an inlet of at least about 2½ inches in diameter. With such a tank construction, it is possible to utilize a filling device which utilizes an essentially hollow displacer that occupies substantially all of the neck portion of the inlet and can also extend therebelow into what is usually termed the main body portion of the tank. With a device of this construction, the vertically downward movement of the funnel portion, either by translation or twisting, e.g. screwing, opens the hollow displacer volume to liquid flow, and the amount of overfill liquid in the funnel is accommodated in this manner.

The use of any of these units allows rapid and complete filling of a container with a flowable fluid to be achieved with minimal risk of spillage.

DETAILED DESCRIPTION OF THE PREFERRED EMBODIMENTS

Illustrated in FIGS. 1 to 5 is a filling unit 11 which is designed to prevent the overfilling of containers having an external attachment means, such as a threaded inlet opening to a small gas tank 13 (shown in dotted outline), to which a cap or the like can be screwed in place to substantially close the tank during normal operating conditions. The filling unit 11 is useful to prevent the overfilling a container of any size and shape with a flowable fluid; however, it is expected to find its primary usefulness to prevent the overfilling of small tanks, such as those commonly found on lawnmowers, snowblowers, outboard motors and the like, with gasoline or the overfilling of space heaters with kerosene.

Figure 1:
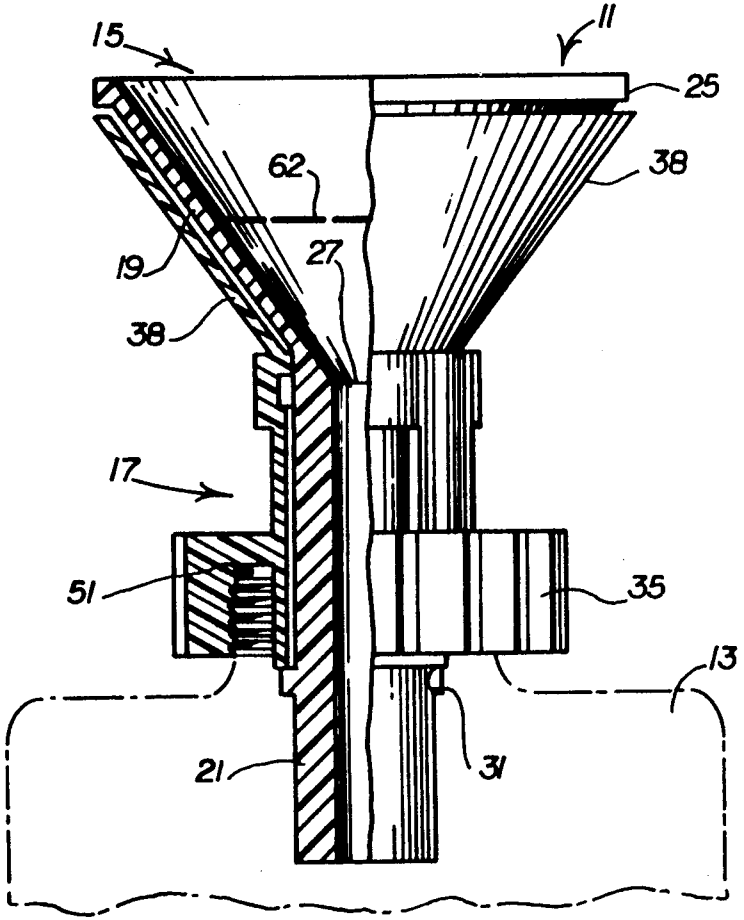
FIG. 1 is an elevational view of a filling unit embodying various features of the invention showing the unit in its lowered, or filling position, with the left half showing the unit in section.

As best seen in FIG. 1, the filling unit 11 includes a funnel unit 15 and a holder unit 17 which are interconnected with each other in a manner so as to be relatively moveable, preferably slidable. The funnel unit 15 includes an upper funnel section 19, a lower displacer section 21 and an intermediate interconnection section 23. The funnel section 19 is preferably frustoconical in shape extending smoothly downward from an upper circular rim 25 of relatively large diameter to a neck 27 of smaller diameter at the upper end of the intermediate throat section 23. Although the funnel section is preferably of conical shape, it could have any suitable shape, for example generally hemispherical.

Figure 2:
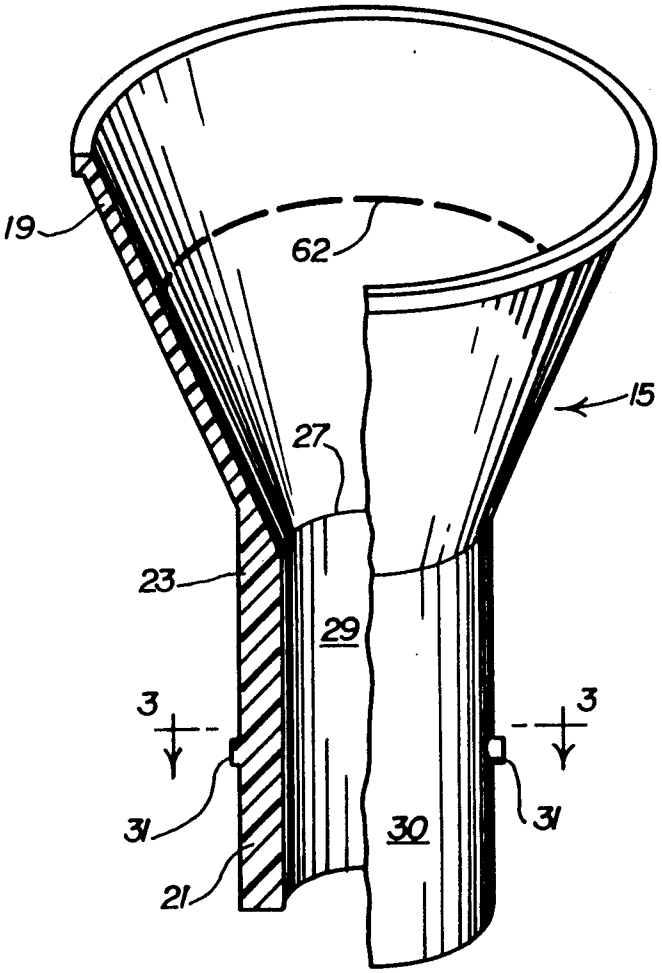
FIG. 2 is a perspective view, with a portion broken away and shown in section, of a funnel portion of the filling unit shown in FIG. 1.

As best seen perhaps in FIG. 2, the outer surface of the intermediate throat section and the lower displacer section is cylindrical of circular cross-section. The interior region of the intermediate section can be enlarged, if desired, but in the illustrated embodiment is straight, i.e. cylindrical. At the junction with the funnel section 19, the passageway has a diameter "d". A pair of retainers or lugs 31, preferably of cylindrical shape, protrude outward from diametrically opposite locations on the outer surface 30 of the displacer section 21 for a purpose to be explained hereinafter.

Figures 3, 4, 5, 6, 7, 8:
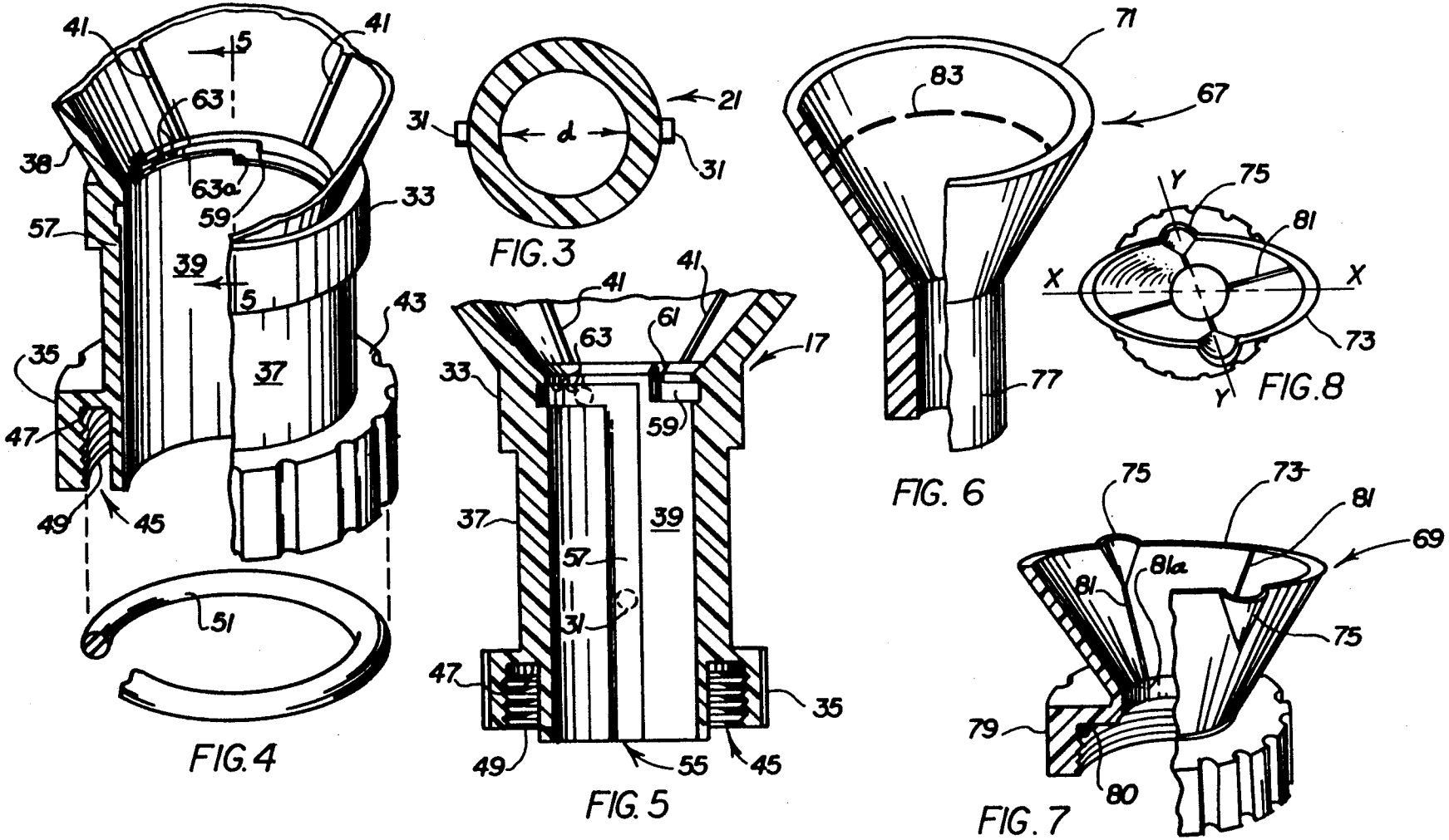
FIG. 3 is a sectional view of the funnel portion of FIG. 2 taken generally along the section line 3—3 of FIG. 2.
FIG. 4 is an exploded fragmentary perspective view of the holder portion of the filling unit shown in FIG. 1, with portions broken away and shown in section.
FIG. 5 is a sectional view taken along the line 5—5 of FIG. 4.
FIGS. 6 and 7 are perspective views of a funnel portion and a holder portion of an alternative embodiment of filling unit embodying various features of the invention, with portions of both being broken away and shown in section.
FIG. 8 is a top view, slightly reduced in size, of the holder portion of FIG. 7.

The holder unit 17, as perhaps best seen in FIG. 4, includes a collar section 33, a lower attachment section 35, an intermediate body portion 37 and a frustoconical upper extension 38 which is proportioned to receive the funnel section 17. The interior surface of the upper extension 38 has formed therein a series of generally radially extending ridges or lands 41. The interior surface 39 of the holder 17 is preferably cylindrical and is proportioned so as to be relatively rotatable with the outer surface 30 of the displacer section of the funnel unit. The proportioning is such that either a large gap is provided which easily drains or, preferably, a close seal is provided that deters liquid flow therebetween these surfaces.

The lower attachment section 35 of the holder flares outward from the cylindrical body section and is preferably contoured to allow it to be gripped by one's fingers. In the illustrated embodiment, a plurality of vertical grooves 43 are provided; however, other alternative structures could be used, for example, a plurality of parallel ridges. The attachment section 35 is formed with a downwardly open cavity 45 which has an upper annular end wall 47 and an outer wall surface that is formed with internal threads 49 that mate with the usual external threads that are found on the inlet opening of the usual lawnmower or snowblower tank. The thickness of the cavity 45 is such as to accommodate the wall thickness of the usual inlet for a small tank of this type. A sealing member of annular form, preferably an O-ring 51, is preferably located at the upper end of the cavity 45 against the end wall surface 47 where it forms a seal against the upper edge of the inlet to the small tank, when the holder unit 17 of the filling unit is threaded into its installed position.

As best seen in FIG. 5, the relative movement between the funnel unit and the holder unit is provided through the interengagement of the lugs 31 within a pair of grooves 55 that are formed in the interior surface 39 of the holder. Each of the grooves 55 includes a straight vertical section 57 which is surmounted by a horizontal leg 59 which terminates in an uppermost vertical entrance leg 61. To mate the funnel unit 15 to the holder unit 17, the lugs 31 are aligned with the entrance legs 61 of the grooves, and the funnel unit is moved relatively downward so that the lugs enter the horizontal legs 59. The funnel unit is then rotated relative to the holder unit, causing the lugs 31 to partially traverse the horizontal legs leading to the upper ends of the main vertical sections 57 of the grooves 55. In this relative orientation, the filling unit is ready for installation on top of a small tank or the like that is to be filled with a flowable substance, e.g. gasoline.

To prevent inadvertent disengagement of the funnel unit from the holder unit after the two have been mated, one or more detents 63 (FIG. 5) may be provided, and a step or interruption 63*a* (FIG. 4) in the groove is also preferably provided. Such detents 63 extend sufficiently far into the horizontal leg 59 of the groove to nominally block the direct passage of the lug through this section and may be located in the horizontal leg of the groove, e.g. between the junction with the vertical leg 57 and the groove interruption 63*a*. The proportioning of the detents 63 should be such that, depending upon the resiliency of the plastic material from which the funnel unit and the holder unit are constructed, there would be sufficient spreading and/or compression to permit the lugs to be moved fairly easily therepast by twisting the two units relative to each other. If desired, the detents 63 are spaced apart so as to accommodate the lugs 31 therebetween within the horizontal leg and thus create a "lock-up" position where the two units will remain mated together with the lugs 31 seated in the horizontal legs of the grooves 55.

The threaded cap is then unscrewed from the top of the tank 13, providing access to the inlet, and the cavity 45 in the attachment section 35 is aligned with the neck of the inlet. The unit 11 is threaded downward onto the upper end of the inlet until the O-ring 51 seals against the upper edge of the gas tank inlet, thus providing a liquid and air tight seal in this region. Next, the funnel unit 15 is rotated until the lugs 31 reach the vertical sections 57 of the groove and then depressed so that the displacer section 21 slides vertically downward within the body of the holder unit 17 and the displacer section enters into the upper region of the tank to be filled. As best seen in FIG. 1, the downward translation of the funnel unit 15 is halted when the outward-flaring funnel section engages the series of ridges 41 in the upper extension 38 of the holder.

The proportioning between the relative lengths of the funnel unit 15 and the holder unit 17 is such that relative axial sliding movement equal to a distance substantially equal to the length of the vertical section 57 of the groove is permitted. Accordingly, when the funnel unit has been moved axially downward as far as permitted, until there is engagement between the outer surface of the funnel section 19 and the ridges 41 of the upper extension, the lugs 31 will have completely traversed the entire length of the groove sections 57; in this position, twisting of the funnel unit relative to the holder unit moves the lugs out of alignment with the slots 55 and thus establishes a "lock-down". Such a lock-down position is valuable to assure that the displacer section 21 will not inadvertently float upward as the liquid level rises in the tank, thus eliminating the advantage of having the displacer section remain within the confines of the tank throughout the entire filling step. If desired, detents or shallow recesses may be provided along the bottom edge of the holder section to stabilize the lock-down position, and the lower ends of the vertical sections 57 of the grooves may be slightly flared outward so as to provide a ready entrance for the lugs 31 back into the grooves when the filling operation has been completed and it is ready to move the funnel unit upward into its lock-up position. If desired, the intermediate body portion 37 of the holder could be shortened in height to lower the profile of the filling unit 11, and if so, the intermediate section 23 of the funnel unit 15 would be likewise shortened.

The filling of the tank proceeds, with the funnel unit in the lock-down position, by pouring liquid into the funnel section and allowing it to run downward through the interior passageway (which is always open to liquid flow) of the intermediate section and the displacer section into the tank. By always open is meant that the passageway through the funnel unit into the tank is always clear and is of a size such that liquid will flow freely therethrough; preferably, it has an effective cross section equal to a circle of at least ¼ inch in diameter through which liquids of normal viscosity will flow without significant retardation because of surface tension. Air within the tank can initially escape either upward through the interior passageway or the air vent system or both until the liquid level rises above the bottom of the displacer section 21; thereafter, air escapes through an air vent system provided via the two grooves 55 in the interior surface of the holder section. With the funnel unit in the lock-down position, these grooves provide completely open vent passageways leading upward to regions between the funnel sections and the upper extensions 38 created by the ridges 41 which should be at least about 1/64 inch in height. However, once the liquid level blocks the entrance to the interior passageway and the vent system, air flow from the tank will slow or cease, causing the liquid to more slowly flow out of the funnel and alerting the person pouring the liquid that the tank is nearly full. When the level of the liquid within the tank rises above the lower end of the holder section 17 so that air can no longer reach the grooves 55, air will become trapped within the small unfilled volume located within the tubular inlet to the tank 13 and eventually become compressed, preventing the further rise in the level of liquid within the tank. It is intended that the person filling the tank stops pouring liquid into the funnel when the liquid reaches a reference level in the funnel unit, and preferably a mark 62 of some type is used to provide a visual indication of a predetermined level above which the liquid level should not extend.

After the person filling the tank stops pouring, he simply manually grasps the upper end of the funnel unit 15, rotates it until the lugs 31 enter the bottoms of the grooves, and pulls it vertically upward causing the lugs to slide upward in the vertical legs 57 of the grooves until they reach the horizontal legs 59. Further rotation until the lugs engage the detents 63 moves the unit into the lock-up position. The upward translation of the displacer section 21 from the tank provides the additional minimum amount of volume desired within the tank to accommodate all of the liquid that earlier filled the funnel section up to the predetermined line 62. As explained in detail hereinbefore, the minimum volume desired is based upon adequate eye-hand coordination in halting pouring of the liquid when the outflow of liquid from the funnel begins to perceptively slow, and this is calculated by the mathematical formula: $V=0.26\times 4d(d^2+dD+D^2)$. In the embodiment illustrated in FIGS. 1 through 5, d is equal to the diameter of the throat through the hollow lower portion of the funnel unit (which in the illustrated embodiment is of substantially constant diameter), and D is equal to 4 d. Accordingly, the relatively thick walled annular displacer section of the funnel unit is dimensioned so as to be at least equal to this value.

As best seen in dotted outline in FIG. 5, the width of the grooves is substantially greater than the diameter of the lugs so that there is clearance through which any air being displaced can freely flow past the lugs as they slide up the vertical legs 57 of the grooves. The holder section 17 can then be unscrewed by grasping the outer surface of the attachment section 35, and once it is removed, the tank cap is replaced. Thus, it can be seen that the filling unit 11 allows the rapid and accurate filling of a small tank to a full condition without the danger of overfilling the liquid.

Illustrated in FIGS. 6-10 of the drawings is an alternative embodiment of a filling unit 65 embodying various features of the invention and generally resembling that shown in FIGS. 1 through 5. The filling unit 65 includes a funnel unit 67 (FIG. 6) which is received within a holder unit 69 (FIG. 7). One difference between filling unit 65 and that previously described is that the funnel section 71 of the funnel unit 67 and the upper extension 73 of the holder unit 69 are oval in cross section, as opposed to being circular, as best seen in FIG. 8. The ovality of the otherwise frustoconical sections provides a simple way of supporting the funnel unit 67 in the elevated orientation where the overfill liquid drains into the tank, as can be seen hereinafter. This is achieved through the provision of a pair of ears 75 that are formed in the upper edges of the holder upper extension section 73 and which are strategically located so that, when the funnel unit is supported in these two ears, the displacer section 77 is essentially totally withdrawn from the main body portion of the tank, as described hereinafter.

Figure 9:
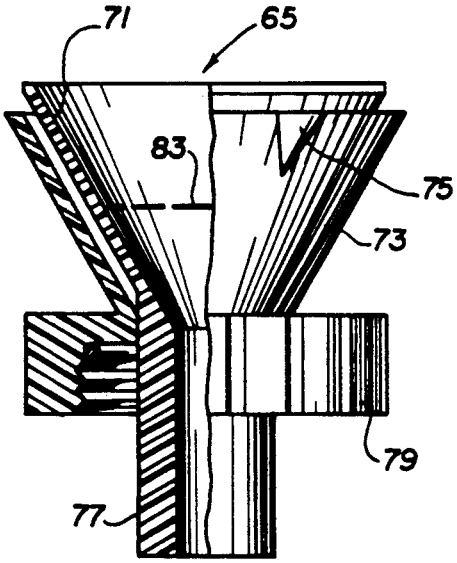
FIG. 9 is an elevational view, with the left half being shown in section, of the assembled filling unit depicted in FIGS. 6 through 8 shown in the filling position.

The holder section 69 includes an attachment section 79 that is proportioned to interengage with the external threads on the inlet opening of the usual small engine gasoline tank and carries an O-ring 80 for creating a seal at the upper edge of the neck of the inlet. The connection between attachment section 79 and the remainder of holder unit 69 can be resilient or the like, to allow some adjustment of holder unit 69 to accommodate external interferences. The interior surface of the upper extension 73 is formed with a plurality of generally radially extending ridges 81 which serve the same purpose as the ridges 41 previously described to ensure an air vent passageway exists between the generally frustoconical mating surfaces in the filling position. The ridges 81 extend down into the neck of the holder section, as best seen in FIG. 7, and these ridge extensions **81*a* are proportioned so that there will be a frictional fit between the neck section of the holder and the cylindrical outer surface of the funnel unit 67 such that the funnel unit will remain in its lowered filling position and not float upward when the gasoline or other liquid reaches a level near the top of the tank. Alternatively, the funnel unit could be molded from a heavier thermoplastic material which would have a specific gravity greater than that of the liquid in question, or a metal ring could be applied or molded into the displacer section 77 of the funnel unit so as to assure such floating will not occur. As seen in FIG. 9 showing the filling position, the displacer section 77 is located in its downwardly extended position where it occupies a substantial volume within the upper region of the tank being filled; this volume is at least equal to the minimum desired volume as discussed hereinbefore. The upper funnel section 71 of the funnel unit carries a predetermined level indicia or marking 83** which provides the user with a guide so as to stop pouring liquid into the funnel before the static level reaches this mark.

Figure 10:
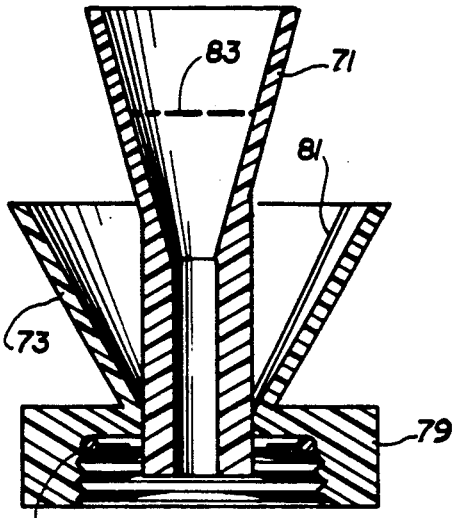
FIG. 10 is a view similar to FIG. 9 showing the filling unit with the funnel portion in the elevated position.

Upon completion of filling to about the level 83, the user grasps the upper rim of the funnel unit and manipulates it so as to translate it vertically upward while twisting it with a clockwise rotation so as to align the long axis of the oval funnel section 71 (as depicted in FIG. 8 by the line x—x), with the pair of diametrically opposed ears 75 in the extension section of the holder (which are aligned on line y—y of FIG. 8). To reach this orientation, a rotation of about 75° to 80° occurs in the illustrated embodiment, and as a result of the ovality, the displacer section 77, as can be seen in FIG. 10, was moved vertically upward so that it is now located in a region above the main body of the tank, allowing the overfill liquid which occupied the funnel unit up the line 83 to drain completely into the tank. As soon as draining is complete, the unit 65 is unthreaded from the inlet opening to the tank, and the cap is replaced.

Figure 11B:
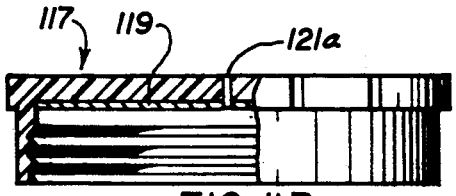
FIG. 11B is a view of a storage cap designed to screw onto and close the inlet to the tank to which the filling unit of 11A is installed.
Figure 11A:
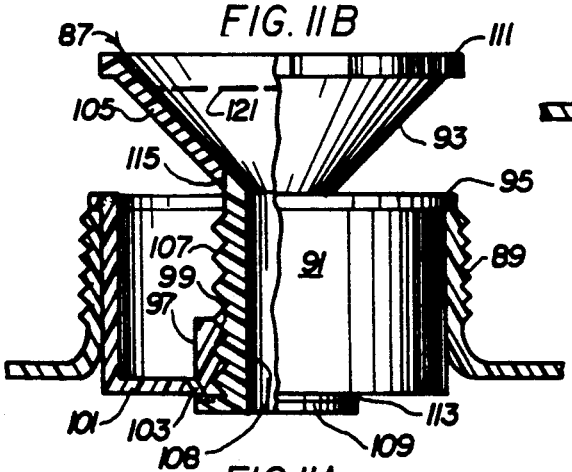
FIG. 11A is a view similar to FIG. 1 of another alternative filling unit embodying various features of the invention, shown in the filling orientation.
Figure 12:
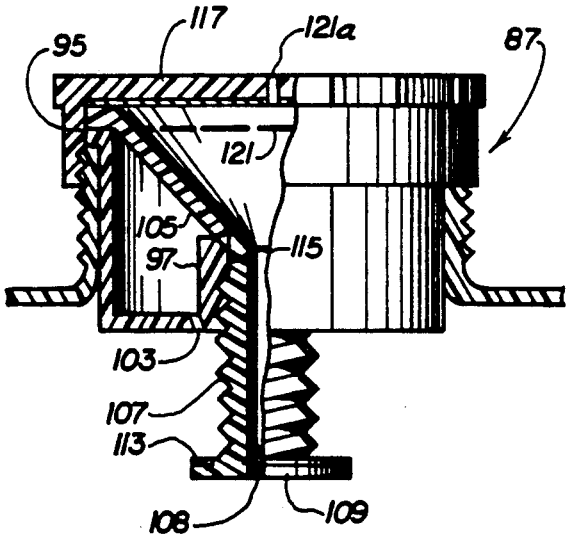
FIG. 12 is a view of the filling unit illustrated in FIGS. 11A and 11B shown in the storage orientation.

Illustrated in FIGS. 11A, 11B, and 12 is another alternative embodiment of a filling unit 87 of a design so as to be permanently mounted within the tubular inlet 89 of a tank for supplying fuel to a small engine or a heater or the like. In recent years, tanks for gasoline-powered devices such as lawnmowers, snow blowers, etc. have become to be equipped with inlet openings of a diameter of about 2½ inches, and these larger diameters provide the opportunity for creating a filling unit that can be permanently installed therein. The unit 87 utilizes a hollow displacer which is actuated by manipulating a cooperating element so that it is moved between a vertically elevated filling position and a vertically lowered storage position.

In FIG. 11A, the filling unit 87 is illustrated in its raised filling orientation; it includes two relatively movable elements, a holder unit 91 and a generally centrally located funnel unit 93. The holder unit 91 has the shape of an upwardly open cup which has an outer diameter such that it is snugly received within the interior of the tubular inlet 89 of the tank, to which it is permanently suitably cemented. If desired, a thin, flat annular gasket can be provided adjacent the undersurface of a lip 95 at the top of the holder unit 91 so as to assure a tight seal is established between the interior wall of the inlet and the outer surface of the cup portion of the holder unit. An enlarged boss 97 having an internally threaded central aperture 99 is formed in the bottom wall 101 of the holder unit, aligned axially therewithin. As best seen in FIG. 12, one or more holes 103 for liquid passage are provided adjacent the periphery of the central boss 97, in surrounding location to the internally threaded aperture, to initially permit flow of liquid from the underlying region of the tank into the hollow interior of the cup-like holder unit and to subsequently serve as drain holes.

The funnel unit 93 is preferably manufactured in two pieces, which are mated to one another during the assembly of the funnel unit with the holder unit. The funnel unit 93 includes a frustoconical funnel section 105 and a lower stem section 107 having a central always open passageway 108 of constant diameter. The stem section 107 has an exterior thread which mates with the interior thread in the boss aperture 99 and has a bottom circular flange 109 of sufficient diameter so as to block flow through the holes 103 in the cup bottom wall that surround the boss. The funnel unit has an upper rim 111 of a diameter substantially the same as the diameter of the lip 95 at the top of the holder unit and has a knurled outside surface to allow it to be grasped and rotated. A flat annular gasket 113 is preferably disposed upon the upper surface of the bottom flange 109 of the stem section 107 to assure a good seal between it and the undersurface of the holder unit when the funnel unit is in the elevated filling position.

In assembly of the filling unit, the annular gasket 113 is installed, and the stem section 107 is then threaded through the axially located aperture 99 in the boss 97. Thereafter, a pair of short cylindrical surfaces 115 at the upper end of the stem section 107 and the lower, smaller diameter end of the funnel section 105 are appropriately joined, e.g. adhesively, to each other to complete the assembly. To install the filling unit in the opening to a gas tank, the standard gas tank cap 117 depicted in FIG. 11B is first removed. The cap preferably has a standard gasket 119 at the undersurface of its top wall to create a liquid seal when it is screwed into place on the threaded tubular inlet 89 of the tank, and it has the usual central vent opening 121 a to permit slow escape of vapor should there be a pressure buildup within the tank as a result of high temperatures. With the cap 117 removed, the unit 87 is inserted, and the exterior surface of the holder unit 91 is cemented or adhesively attached to the interior surface of the tubular inlet 89, with the low profile lip 95 located in contact with the upper edge of the tubular inlet.

With the holder unit 91 secured in place, the funnel unit 93 is turned counterclockwise, as viewed from above, so as to cause it to extend vertically upward to its highest position, in which the annular gasket 113 will be compressed between the undersurface of the central boss portion of the holder unit and the upper surface of the flange 109 at the bottom of the stem section 107 of the funnel unit. As a result, the entrance from below through the holes 103 leading into the hollow interior of the holder unit is sealed and blocked. In this orientation, the unit 87 is ready for the tank to be filled with liquid.

In the illustrated embodiment, when liquid is poured through the funnel and flows through the always open central passageway of the stem section, air within the tank is allowed to escape directly up the filling passageway through the hollow stem section 107; however, one or more vent passageways could be molded into the stem section if desired. These passageways would extend vertically upward through the stem portion and join passageways either molded in the sidewall of the funnel section 105 or provided in the surface of the funnel section similar to those described hereinafter with respect to the filling unit illustrated in FIGS. 19–22. The minimum desired volume to accommodate lag time is calculated based upon the diameter of cylindrical passageway in the stem section 107, and it is found to equal a volume represented by liquid extending upward to reference marks 121 provided on the interior surface of the funnel section. The holder unit 91 is accordingly constructed so as to provide within its interior hollow region, sufficient void volume to accommodate this amount of liquid.

Accordingly, when filling to about the reference mark 121 has been completed, the user begins to turn the knurled upper rim 111 of the funnel unit clockwise so that it slowly translates downward into the neck of the tank inlet. As soon as the gasket 113 on the bottom flange 109 of the stem unit moves away from the undersurface of the holder, liquid in the tank begins to flow upward through the holes 103 into the hollow region and to simultaneously drain downward to some extent from the interior of the funnel section 105. In addition, the flow of liquid entering the hollow region of the holder (which serves as a displacer in this construction) is accommodating the liquid being displaced as a result of the stem section 107 being screwed downward into the tank itself. The sizing of the hollow section of the holder unit 91 is such that an amount of liquid greater than that displaced by the stem section is accommodated within the generally annular hollow region, and thus the liquid level within the funnel section 105 drops below the reference mark 121. When the funnel unit has been threaded to its lowered position so that the undersurface of the rim on the funnel unit engages the upper edge of the holder unit, the filling unit 87 has reached its storage orientation (as shown in FIG. 12), and the cap 117 for the tank is threaded onto the tubular inlet 89 above the stored filling unit 87.

Figures 13, 14:
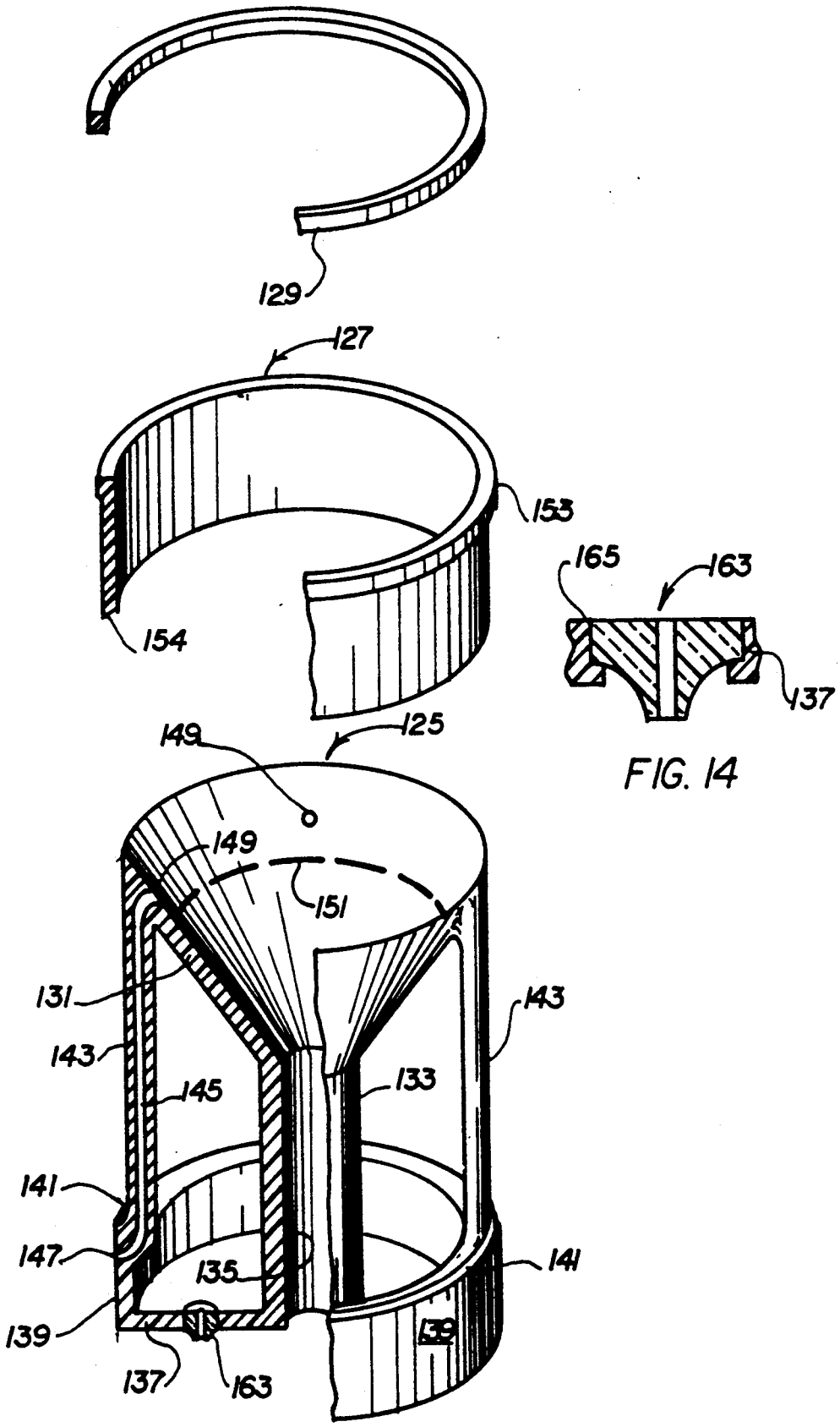
FIG. 13 is an exploded perspective view of portions of still another alternative embodiment of a filling unit with portions broken away and shown in section.
FIG. 14 is a fragmentary sectional view, enlarged in size, showing a portion of the bottom element of FIG. 13.

Illustrated in FIGS. 13–18 is yet another filling unit 123 which somewhat resembles the filling unit just described with respect to FIGS. 11 and 12 in that it also utilizes a hollow displacer section, and wherein the unit 123 also has a vertically elevated filling orientation and a lowered storage orientation. As best seen in FIG. 13, the unit 123 is essentially made of three separate molded pieces, i.e. a funnel unit 125, a surrounding generally tubular holder unit 127 and an upper retaining ring 129.

The funnel unit 125 includes an upper frustoconical funnel section 131 from which depends a tubular lower section 133 having an always open central passageway 135 with constant throat diameter, which section extends to the bottom of the unit. An annular bottom wall 137 extends radially outward from the bottom of the tubular section and joins an outstanding annular sidewall 139 which has an oblique upper edge 141 that functions as a sealing surface as described in detail hereinafter. Four posts 143, spaced regularly at 90° intervals about the circumference, extend from the interior surface of the annular sidewall 139 to the undersurface of the frustoconical funnel section 131, meeting the funnel section along its outer edge. These posts 143 are formed to have longitudinally extending central passageways 145 which serve as vent passageways and which lead from four angularly oriented entrances 147 formed in the outer surface of the upstanding sidewall to four exit holes 149 which appear in the interior surface of the funnel section at a location above reference marks 151 which mark the predetermined level of fill. The posts 143 not only provide vent passageways, but they also serve as frictional bearing surfaces which rub against the interior surface of the tubular holder 127 as explained hereinafter.

The holder 127 is formed with a tubular sidewall having an outwardly extending lip 153 at its upper end and an oblique lower wall 154, which as explained hereinafter is designed to seal with the upper edge 141 of the upstanding sidewall 139 of the funnel unit. The dimensions of the holder are such that it is snugly received within the interior of the tank inlet and is adhesively joined thereto with the upper lip 153 resting on the upper edge of the inlet 55. The inner dimension of the holder is such that it is essentially the same as the inner diameter of the upstanding sidewall portion 139 of the funnel unit, and it preferably frictionally bears against the outer surfaces of all four of the upstanding posts 143. In the assembly of the unit, the holder 127 is lowered over the funnel section 131 and slides downward along the outer surfaces of the four posts 143. With the holder 127 thus mated to the funnel unit 125, the upper retainer ring section 129 is affixed in place using a suitable adhesive (or by thermal bonding) along the mating surfaces at the top of the exterior of the funnel section 131.

To install the completely assembled unit in a gasoline tank or the like, the tank cap is removed, and the bottom end of the funnel unit 125 is pushed through the inlet opening. Preferably, adhesive or cement is applied to the exterior surface of the holder 127 before it is pushed downward snugly into the interior of the tubular inlet so that the upper lip 153 seats atop the upper edge of the tubular inlet.

Figure 18:
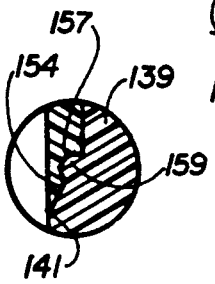
FIG. 18 is an enlarged "bull's-eye" view of a portion of the unit shown in FIG. 15, enlarged in size to illustrate the details of the seal-support.

After the adhesive or cement has hardened and one is ready to fill the tank, the user grasps the retainer ring 129 and pulls the funnel unit 125 upward. The unit slides smoothly upward with frictional force between the four posts 143 and the interior surface of the holder 127 maintaining the filler unit in alignment. The funnel unit is moved vertically upward until the oblique surfaces 141, 154 engage each other and create a seal to liquid flow therepast. To assure that a very good seal is created and to also assure that the funnel unit 125 will remain in the raised position, a tongue-and-groove arrangement is preferably molded into the two mating oblique surfaces, as best seen in FIG. 18. The oblique lower surface 154 of the holder is preferably formed with an annular groove 157 that continues for 360 about the surface. Similarly, the upper oblique edge surface 141 of the upstanding sidewall portion 139 of the funnel unit, which has the same angular orientation, is formed with a mating tongue or bead 159 which is proportioned to snap into the groove 157 when the funnel unit 125 reaches its elevated filling position; thus, the mating of the tongue-and-groove assures not only that there is a 360° seal about the hollow interior of the lower portion of the funnel unit (which serves as a displacer section in this filling unit 123) but also assures that the unit will remain in its uppermost filling orientation until the user applies pressure to break the seal between the tongue-and-groove arrangement and cause it to translate downward.

Figure 15:
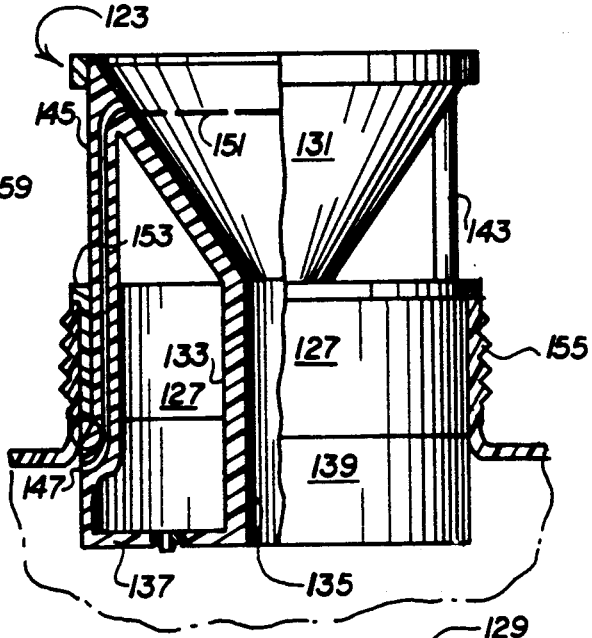
FIG. 15 is a view, similar to FIG. 1, of the filling unit incorporating the structure of FIG. 13, installed in a tank inlet and shown in the filling position.
Figure 16:
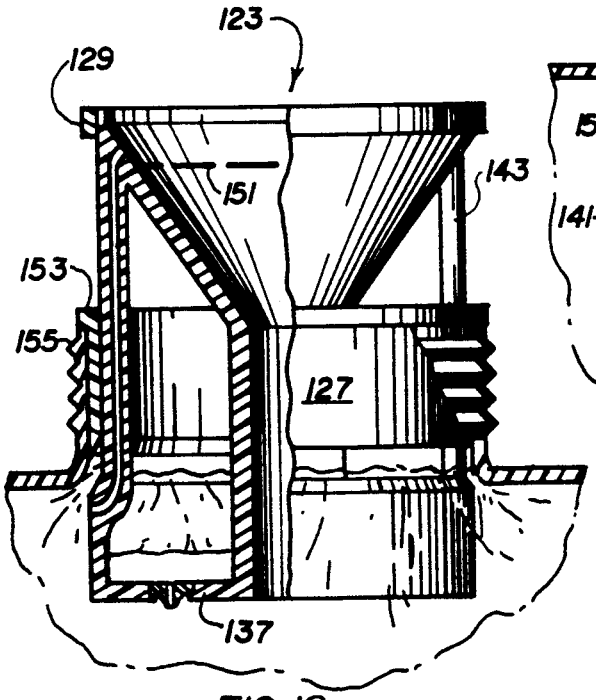
FIG. 16 is a fragmentary view similar to FIG. 15, but shown after the tank has been filled and the funnel portion has been manipulated slightly vertically downward to begin the filling of the hollow displacer portion.
Figure 17:
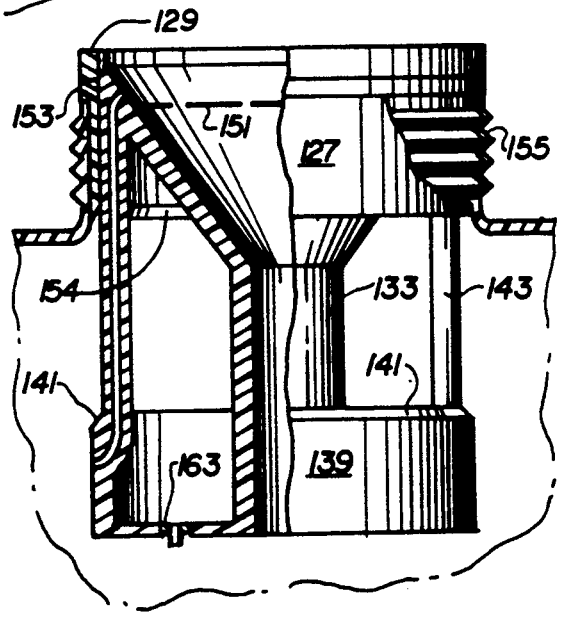
FIG. 17 is a view similar to FIG. 15 showing the filling unit in its completely lowered storage position.
Figure 20:
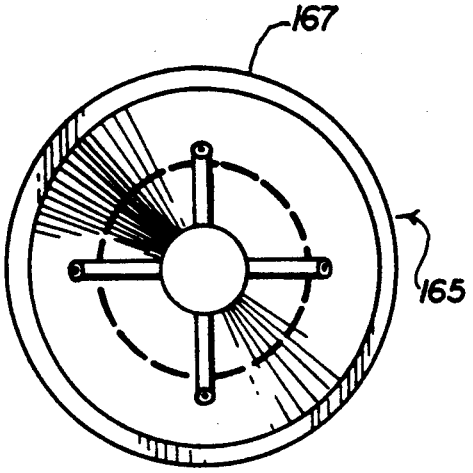
FIG. 20 is a top view of the filling unit of FIG. 19.

Accordingly, with the filling unit 123 in the orientation shown in FIG. 15, the tank is filled with liquid, the level of which is allowed to extend upward to the reference line 151 within the funnel section. After the user sets down the tank of fuel, he applies pressure to break the seal at the mating surfaces and to slightly depress the funnel unit 125. As depicted in FIG. 16, as soon as the funnel unit 125 is slightly lowered, liquid from the tank pours over the upper edge of the upstanding sidewall 139 and begins to fill the hollow interior region that is provided in the annulus between the upstanding sidewall and the central tubular section. The funnel unit 125 is ultimately caused to slide vertically downward until the retainer ring 129 seats atop the upper surface of the lip 153 of the holder, as illustrated in FIG. 17. In this lowered orientation, some of the liquid from within the funnel section 131 has become accommodated within the hollow interior region of the displacer section, and the filler unit is now in its storage configuration, which permits the user to reinstall the gas tank cap on the outer threaded surface of the upstanding tank inlet 155.

As the gasoline or other fuel within the tank is slowly used, the liquid level drops below the bottom wall 137 of the filler unit, and the fuel which earlier overflowed the upstanding sidewall 139 is allowed to drain from the hollow region through a drain valve 163 provided in an aperture 165, best seen in FIGS. 13 and 14, in the bottom wall. A soft rubber drain valve 163, of a type well known in the art, is adhesively or otherwise affixed in the aperture 165 in the bottom wall 137; it serves as a fairly efficient check valve which allows flow only downward through the aperture. Because of the soft rubber design, the valve 163 tends to distend along its thin lower end upon the application of back-pressure and effectively thwarts any significant flow of liquid upward through it, while permitting liquid in the region thereabove to slowly drain downward by gravity through the narrow central opening as the contents within the tank are used.

Illustrated in FIGS. 19 through 22 is a further embodiment of a filling unit 165 embodying various features of the invention which is somewhat simpler in construction than the embodiments earlier illustrated and described. The unit 165 has no relatively movable pieces but is instead a single integral unit having an upper funnel section 167 and a lower displacer section 169 which includes a central throat 171 which provides an always open passageway from the funnel section 167 into the tank. The lower displacer section 169 is tubular in construction having a relatively thick sidewall, that is preferably slightly thicker than the diameter of the central throat 171. The funnel section 167 has an upper annular rim 173 that facilitates handling. Although the funnel section is preferably conical, it could have any suitable shape such as rectilinear, e.g. pyramidal.

Figure 22:
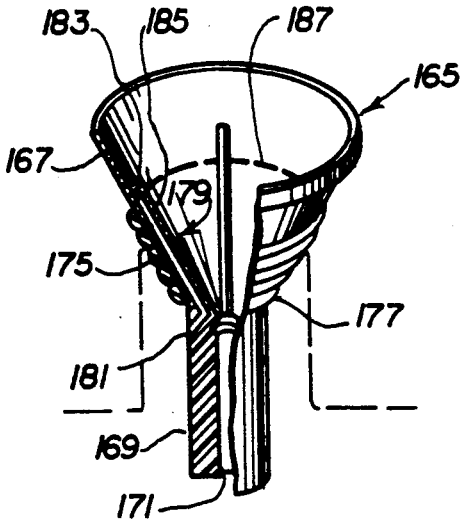
FIG. 22 is a perspective view, with portions broken away and shown in section, of the unit of FIG. 19 installed in an inlet opening to a small tank which is shown in dotted outline.
Figure 19:
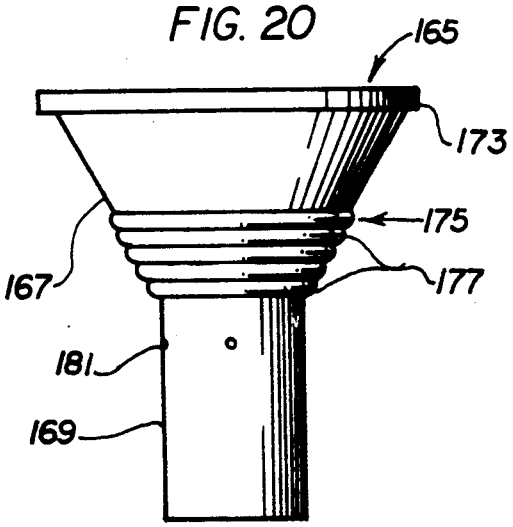
FIG. 19 is an elevational view of a further embodiment of a filling unit incorporating various features of the invention.

A holder 175 in the form of a segmented sealing ring of resilient synthetic rubber material fits snugly about the exterior of the unit and is adhesively connected surface-to-surface thereto. As can be seen from FIG. 22, the sealing ring or holder 175 extends from about the top of the cylindrical displacer section 169 a substantial distance up the exterior surface of the funnel section 167. The holder 175 is molded so as to have five segments 177 of regularly vertically increasing diameter. The diameters are chosen so that the sealing ring of the unit will be resiliently accommodated within the inlet opening of most standard fuel tanks. Installation is shown in FIG. 22 where the tubular inlet is shown in dotted outline, and it can be seen that the central segment 177 of the five segments would be distended slightly in sealing engagement with the interior surface of the upper end of the inlet opening, thus creating a liquid-tight seal at this location that would prevent the flow of liquid or vapor out of the inlet opening until the unit 165 has been removed.

To assure prompt filling of the container to the desired level, a series of four air vent passageways 179 are provided in the sidewall of the unit 165. The passageways have angularly oriented entrances 181 which intersect the exterior sidewall at locations just below the holder and interconnect with generally radially extending passageways 183 formed in four separate hollow ribs or straws 185 that protrude upward from the interior surface of the funnel section of the unit. The upper ends of these hollow ribs 185 terminate at locations above a set of reference marks 187 which indicate the average predetermined level to which it is desired to fill the tank-installed funnel unit when inserted to the extent of the middle of the five segments 177.

To fill a small tank, the user removes the fuel tank cap and inserts the filling unit 165 to the extent that the resilient holder 175 has one of its segments 177 slightly compressed so as to create a good seal that will prevent the flow of liquid or gas out the tubular inlet at this location. The volume of the displacer section 169 that extends into the tank is such as to displace at least the predetermined desired amount of liquid as calculated by the formula set forth hereinbefore, with the throat d being the dimension of the central passageway 171 through the tubular displacer section. Once the liquid level in the tank gets above the bottom edge of the unit, the flow of liquid will begin to perceptively slow because all of the air being displaced must then exit via the four vent passageways 179. Accordingly, the user is able to stop pouring liquid when the level is at about the predetermined level indicated by the reference marks 187 in the funnel section. After setting down the fuel can, the user firmly grasps the upper rim 173 of the unit and quickly pulls the filling unit directly vertically upward, preferably stopping with the bottom of the displacer 169 an inch or less above the top of the inlet while the fuel in the funnel flows quickly into the tubular inlet, filling the space earlier occupied by the displacer section and assuring that a completely full tank is obtained without spilling fuel.

Figure 23:
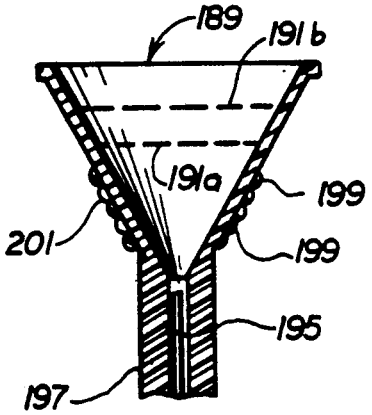
FIG. 23 is a sectional view, generally similar to the left-hand portion of FIG. 22, illustrating yet another filling device embodying various features of the invention.
Figure 21:
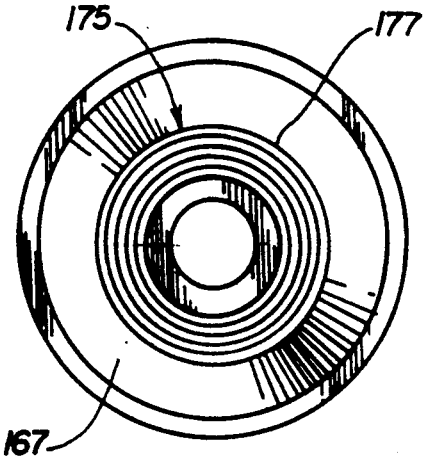
FIG. 21 is a bottom view of the filling unit of FIG. 19.

Illustrated in sectional view in FIG. 23 is an alternative embodiment of a filling unit 189 similar to that shown in FIGS. 19-22 wherein the air vent passageways in the form of the hollow ridges are eliminated and wherein two separate indicia 191*a* and *b* are provided so as to indicate different predetermined levels dependent upon the extent to which the filling unit is able to be inserted into the container inlet. To provide an air vent passageway which is effective up to a level just below the throat of the funnel section 193, a pair of diametrically opposed elongated slots 195 are provided in the sidewall of the hollow tubular stem or displacer section 197 to allow air in the container to continue to escape upward through the always open central passageway until the level of liquid in the tank reaches about the throat of the funnel section. The two spaced-apart indicia 191*a* and *b* marked in the interior surface of the funnel section are relatively positioned so that the lower set of marks 191*a* is designed to indicate the liquid level that can be accommodated when the filling unit 189 is inserted into a relatively small inlet opening of a container, so that a bottom segment 199 of the holder 201 is sealed with the interior surface of the inlet wall. Similarly, the upper set of indicia 191*b* is positioned so as to mark the level of liquid that can be accommodated in the funnel section when the filling unit 189 is fully inserted into a slightly wider inlet opening wherein the uppermost of the five segments 199 of the holder 201 is sealing against the interior surface of the tubular inlet. When the sealing occurs at one of the three intermediate segments, the user notes this and visually adjusts his pouring so that the liquid in the funnel section 193 does not exceed an approximate predetermined level appropriately between the two indicia.

Figure 24:
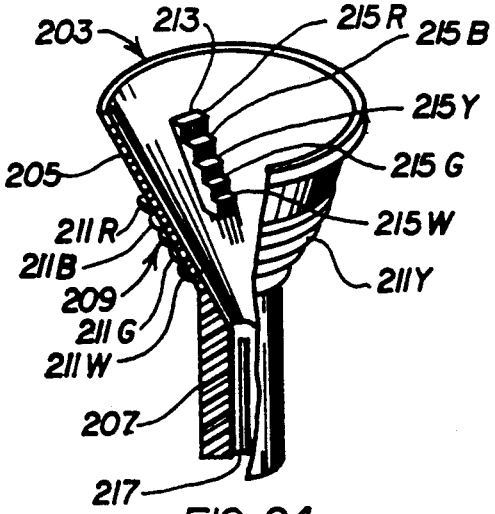
FIG. 24 is a sectional view, similar to FIG. 23, showing still another similar filling device embodying various features of the invention.

Illustrated in FIG. 24 is still another alternative filling unit 203, generally similar to that shown in FIG. 23, which includes a funnel section 205, a depending hollow stem section 207 (which serves as a displacer) and a surrounding segmented holder 209 affixed to the exterior surface thereof. In this embodiment, the five segments 211 of the holder are color-coded, as for example in the following manner: the uppermost segment 211R is red, the next segment 211B is blue, the middle segment 211Y is yellow, the next segment 211G is green, and the lowermost segment 211W is white. Corresponding indicia are provided within the interior surface of the funnel section in the form of a step-like projection 213 in which the upper surfaces of the steps are correspondingly color-coded. For example, the uppermost step 215R is red, the middle step 215Y is yellow, etc. One or more elongated slots 217 are also optionally provided in the sidewall of the hollow stem section 207 which provide air vent passageways leading to the always open central passageway until the liquid in the container rises above the top of these slots. Accordingly, the user of the device first notices the color of the holder segment 211 that is sealing to the interior surface of the inlet opening and accordingly halts pouring of liquid into the filling unit 203 when the level of liquid therein reaches the level of the correspondingly colored step.

Although the invention has been described with respect to several preferred embodiments, it should be understood that one having the ordinary skill in the art could make various combinations of, as well as modifications and changes to, the disclosed embodiments without deviating from the invention which is defined by the claims appended hereto. For example, although threaded interconnections are shown, other suitable types of interconnections, e.g. bayonet connections, can alternatively be used. Although O-rings are generally shown, other types of sealing arrangements can be used that employ normal elastomeric, compressive materials i.e. rubber washers, and frequently the type of sealing material that will be employed will be dependent upon the liquid to be received in the tank in question, with which it must, of course, be compatible. Although the filling unit is expected to find its primary use in filling tanks with fuel, it can be used with any liquids or flowable solids, even with fluidized particulate materials. The holder sections and filter sections are preferably molded from suitable tough thermoplastic or thermosetting polymeric material, which material should also be resistant to crazing or other degradation by the fluids to be handled. As previously mentioned, inserts such as metal weights can be molded within portions of the filling units to adjust buoyancy as described. Although preferred vent arrangements are illustrated, other passageway orientations may be used, including extensions that project upward from the funnel unit.

Particular advantages of the invention are emphasized in the claims which follow.

What is claimed is:

1. A filling unit to prevent overfilling of a container having an upstanding generally tubular inlet which container inlet is normally closed by attaching a closure thereto, which filling unit comprises (a) holder means for engaging said tubular container inlet to seal therewith, (b) funnel means of noncircular cross section for receiving liquid and leading to an always open depending passageway into said container, (c) displacer means integral with the lower end of said funnel means and extending into said container through said tubular inlet when installed, said displacer means being circular in exterior cross section and displacing a predetermined amount of liquid in the container so that, when said container is filled with liquid with said displacer in a lower position such that liquid extends upward to a predetermined level in said funnel means, said displaced predetermined amount is sufficient so that the volume of liquid occupying said funnel means up to said predetermined level can be accommodated in said container with said displacer in a raised position, and (d) said holder means having a circular opening proportioned to slidably receive said circular cross section displacer means, whereby filling may be carried out so that the liquid level extends above the upper end of said container inlet to a visible location within said funnel means, and whereby upward vertical sliding and rotation of said funnel means within said holder means substantially removes said displacer means from within the container and engagement between said noncircular cross section funnel means and said holder means supports said funnel means in said raised position and permits all the liquid previously remaining in said funnel means up to said predetermined level to be accommodated in said container.

2. A filling unit in accordance with claim 1 wherein said holder means includes an upper frustoconical extension of noncircular cross section which surrounds said funnel means and extends upward to at least said predetermined level, and wherein air vent passageway means is provided in said holder means which extends from a location within said container to a location which is vertically above said predetermined level and open to the atmosphere, said funnel means having substantially the same shape as said holder means frustoconical upper extension so that said funnel means nests therewithin with said displace in said lower position.

3. A filling unit in accordance with claim 2 wherein said funnel means and said frustoconical extension are both oval in cross section.

4. A filling unit in accordance with claim 3 wherein said air vent passageway means is partially formed in the surface of a wall section of said holder means which defines said circular opening and wherein an upper surface of said holder means extension contains upstanding ridge means which assures space for said air vent passageway means between it and an outer surface of said funnel means.

5. A filling unit in accordance with claim 3 wherein said oval frustoconical extension has a pair of diametrically opposed ears formed along its upper edge which engage and support said funnel means in said raised position after said displacer means has been manipulated vertically upward and substantially removed form said container to allow liquid to drain from said funnel means into said container.

6. A filling unit to prevent overfilling of a container having an upstanding generally tubular inlet which container inlet is normally closed by attaching a closure thereto, which filling unit comprises (a) holder means for engaging said tubular container inlet to seal therewith and containing an opening, (b) first funnel-shaped means integral to said holder means and extending upwards to an open top, (c) second funnel-shaped means for receiving liquid and leading to an always open depending passageway into said container, (d) displacer means integral with the lower end of said second funnel-shaped mean and extending into said container when installed through said holder opening within which it is slidably received, said displacer means in a lower position displacing a predetermined amount of liquid within said container so that, when said container is filled with liquid such that liquid extends upward to a predetermined level in said second funnel-shaped means, said displaced predetermined amount is sufficient so that the volume of liquid occupying said funnel-shaped means up to said predetermined level can be accommodated in said container, said open top of first funnel-shaped means extending upward at least to said predetermined level in said second funnel-shaped means, (f) the inner surface of said first funnel-shaped means and the outer surface of said second funnel-shaped means being noncircular and proportioned so that they nest in at least one relative angular orientation and with said displacer means in said lower position to allow said displacer means to displace said predetermined amount of liquid, and so that in at least one different relative angular orientation and with said displacer means in a raised position wherein it no longer displaces said predetermined amount of liquid, said displacer means is restrained from sliding downward through said holder means opening, whereby filling may be carried out so that the liquid level extends above the upper end of said container inlet to a visible location within said second funnel-shaped means and without overflowing from the top of said first funnel-shaped means, and whereby upward vertical sliding and relative angular rotation of said displacer means within said holder means opening substantially removes said displacer means from within the container and engages said second funnel-shaped means with said first funnel-shaped means to support said displacer means in said raised position to permit all the liquid previously remaining in said second funnel-shaped means up to said predetermined level to be accommodated in said container.

7. A filling unit in accordance with claim 6 wherein said first and second funnel-shaped means are generally oval in cross section.

8. A filling unit to prevent overfilling of a container having an upstanding generally tubular inlet which container inlet is normally closed by attaching a closure thereto, which filling unit comprises (a) a holder unit which includes means for engaging said tubular container inlet to seal therewith and means defining a central passageway therethrough, (b) funnel mean for receiving liquid and leading to an always open depending passageway into said container, (c) displacer means integral with said funnel means and extending into said container through said tubular inlet when installed, said displacer means having a generally cylindrical exterior surface and being slidably received within said central passageway of said holder unit, (d) said holder unit including a frustoconical extension located above said engaging means which extension receives said funnel means and provides air vent passageway means therebetween, and (e) said displacer means displacing a predetermined amount of liquid in the container so that, when said container is filled with liquid such that liquid extends upward to a predetermined level in said funnel means, said displaced predetermined amount is sufficient so that the volume of liquid occupying said funnel means up to said predetermined level can be accommodated in said container, whereby filling may be carried out so that the liquid level extends above the upper end of said container inlet to a visible location within said funnel means as high as said predetermined level, and wherein vertical manipulation thereafter of said displacer means within the container permits all the liquid previously remaining in said funnel means up to said predetermined level to be accommodated in said container.

9. A filling unit in accordance with claim 8 wherein said displacer means is constructed so that said predetermined amount of liquid which is displaced is at least that represented by the formula $V=0.26\times 4d(d^2+dD+D^2)$ where d is the diameter of a circle equal in area to the region of least horizontal cross sectional area in said always open depending passageway and D=4 d.

10. A filling unit in accordance with claim 8 wherein said air vent passageway means extends form a location within said container to a location which is vertically above said predetermined level and wherein said displaced predetermined amount is sufficient to accommodate the amount of liquid occupying said funnel means up to said predetermined level and occupying said air vent passageway means.

11. A filling unit in accordance with claim 10 wherein said funnel means and said frustoconical extension are both generally oval in cross section.

12. A filling unit in accordance with claim 11 wherein said generally oval frustoconical extensions has a pair of diametrically opposed ears formed along its upper edge which support said funnel means in an upward drain position after said displacer means has been manipulated vertically upward to a location withdrawn from said container to allow liquid to drain form said funnel means into said container.

13. A filling unit in accordance with claim 10 wherein said displacer means is vertically manipulatable while said holder unit remains sealed to said container inlet and wherein said means for engaging sd tubular container inlet is affixed to said frustoconical extensions.

14. A filling unit in accordance with claim 13 wherein said air vent passageway means is formed by providing a plurality of upstanding ridges or a plurality of grooves either in an interior surface of said holder unit passageway-defining means or frustoconical extension or in a facing surface of said funnel means.

* * * * *